United States Patent [19]

Desai

[11] Patent Number: 5,010,967

[45] Date of Patent: Apr. 30, 1991

[54] MILLING APPARATUS WITH REPLACEABLE BLADES

[75] Inventor: Praful C. Desai, Houston, Tex.

[73] Assignee: Smith International, Inc., Houston, Tex.

[21] Appl. No.: 349,182

[22] Filed: May 9, 1989

[51] Int. Cl.[5] ..... E21B 10/62

[52] U.S. Cl. ..... 175/406; 166/55.7; 175/412; 407/34; 408/224

[58] Field of Search ..... 175/406, 385, 386, 413, 175/412, 391, 420, 421, 325, 286; 166/55.3, 55.6, 55.7; 407/34, 35, 53, 54, 56, 58, 102, 103; 408/224, 231, 232; 409/143

[56] References Cited

U.S. PATENT DOCUMENTS

| | | | |
|---|---|---|---|
| 1,062,841 | 5/1913 | Mitchel | 175/406 X |
| 1,663,048 | 3/1928 | Hartson | 175/406 X |
| 1,805,991 | 5/1931 | Metzger | 175/412 X |
| 1,819,303 | 8/1931 | Reed et al. | 175/413 X |
| 1,822,216 | 9/1931 | Hartson | 175/406 X |
| 2,427,052 | 9/1947 | Grant | 175/286 X |
| 2,855,994 | 10/1958 | Kammerer, Jr. . | |
| 3,105,562 | 10/1963 | Stone et al. | 175/268 |
| 3,110,084 | 11/1963 | Kinzbach | 166/55.7 X |
| 3,145,790 | 8/1964 | Bridwell et al. | 175/413 X |
| 3,180,439 | 4/1965 | Deely | 175/286 |
| 4,710,074 | 12/1987 | Springer | 175/325 X |
| 4,717,290 | 1/1988 | Reynolds et al. | 407/34 |

*Primary Examiner*—Hoang C. Dang

*Attorney, Agent, or Firm*—Smith International, Inc.

[57] ABSTRACT

An apparatus for milling away tubular conduits encased within well bores is disclosed. The milling device consists of a cylindrical body. The body forms longitudinal slots therein for radially disposed replaceable cutter blades that are inserted through the slots from the inside of the body. A central mandrel mechanically locks the replaceable blades between the mandrel and the tubular body. A finned pilot head or guide is affixed to the downstream end of the milling apparatus, the opposite threaded upstream end is adapted to be connected to a drill string.

3 Claims, 2 Drawing Sheets

MILLING APPARATUS WITH REPLACEABLE BLADES

BACKGROUND OF THE INVENTION

1. Field of the Invention

The present invention relates to subsurface well bore equipment and more particularly to an apparatus for milling away tubular conduits such as liners encased within well bores.

There is a special need in the oil and gas industry for tools which can remove the casing in an oil and gas well, drill collars, drill pipe and jammed tools. This is accomplished from the surface with a tool on the end of a drill string. The drill string can range from hundreds to thousands of feet in length. Typically, the working area of the milling tool in a well is from three to ten thousand feet or more below the surface. In various operations at this subsurface point, a portion of the well casing may have to be removed so that drilling can be conducted in a different direction or a drill collar may have to be removed. One reason to remove casing is to permit the drilling of an additional well from the main well. Another use for the milling tools is to remove a tool jammed in the well. This latter use entails destroying the tool by milling through the tool and the borehole. This, then, reopens the hole so that drilling may be commenced.

2. DESCRIPTION OF THE PRIOR ART

Milling tools have been used for many years in subsurface operations. Many of these tools have a lower pilot or guide section and an upper cutting section. These tools include pilot mills, drill pipe mills, drill collar mills and junk mills. These mills all have one thing in common, and that is, to remove some material or item from a well hole. Each of these mills accomplishes this function in the same way by reducing the item to shavings, hence, small chips.

The various mills in use have different types of cutter blades. Most of these cutter blades, however, are permanently fixed to the outside surface of the tool by, for example, welding blades on the outer casing to perform the milling function. Once these blades are worn through, the milling tool then has to be replaced. This includes the entire body and connectors associated with the mill.

The prior art is replete with examples of milling tools. An early example of a milling apparatus is found in U.S. Pat. No. 2,855,994. This patent illustrates a number of radially extending milling blades that are metallurgically bonded to the outer casing of the body of the milling apparatus. The blades of the milling tool are oriented with respect to the length of the milling tool at different elevations such that the tool continues to perform the cutting function without flaring the pipe that the tool is cutting as the blades wear out.

As heretofore indicated, once these blades wear out the tool needs to be replaced with a new tool.

Another more recent patent relating to milling tools is U.S. Pat. No. 4,717,290. This milling tool consists of a tool body which has a plurality of cutter blades extending from the body. Each cutter blade has a negative axial rake and essentially constant negative radial rake. Each cutter arm has a close packing of cylindrical cutting grade tungsten carbide inserts, each of the inserts being set at a lead angle of from 0 to 10 degrees. Each of the blades radially extending from the body of the milling tool is oriented in a spiral, or angled pattern, one from the other; each of the blades being equidistantly spaced around the body of the tool.

Again, as these blades wear away, the entire milling tool needs to be replaced including the body and the connecting ends, etc.

There is a whole family of milling tools that have movably expandable arms that extend radially out from the body of the milling tool, the extending operation occurring downhole. U.S. Pat. No. 3,105,562 is typical of these expanding type reamers and milling tools.

The present invention obviates the need to replace the entire body of the milling apparatus by providing replaceable blades for the milling tool. The milling tool of the present invention is comprised of several components that when assembled, firmly locks a series of milling blades through slots in the body of the milling tool. When the blades become worn, the tool is simply disassembled, new blades are inserted through slots formed by a cylindrical housing from the inside of the housing and a central mandrel is then inserted within the housing, thereby locking each of the replaceable blades in place for further milling operations.

The present invention, therefore, has an advantage over the prior art in that the cutting blades are easily replaceable.

Still another advantage of the present invention over the prior art is that different types of milling blades may be utilized in the same body of the apparatus.

Yet another advantage of the present invention over the prior art is that the blades are mechanically locked in place thereby obviating the need to weld the blades to the housing thereby compromising the integrity of the base metal of the blades and the cutting material secured thereto.

SUMMARY OF THE INVENTION

It is an object of the present invention to provide a pipe milling apparatus wherein the milling blades are replaceable.

It is another object of the present invention to provide replaceable blades for a milling tool that has no weldments on the blades that would lead to deterioration of the temper of the blades due to the heat of the welds.

Still another object of the present invention is to maintain the integrity of the carbide cutting elements on each of the blades by brazing the tungsten carbide cutting elements onto the blades in a furnace separate from the housing of the milling device thus maintaining the integrity of the carbide elements.

The foregoing objects and advantages of the present invention are attained by a pipe milling apparatus having a cylindrical body, the body forming a first threaded end adapted to be connected to a drill string. A second downstream open end further forms at least a pair of equidistantly spaced and longitudinally extending slots therethrough. The slots are positioned about midway between the first and second ends of the body.

At least a pair of pipe milling blades are adapted to be inserted through the slots in the cylindrical body from the inside of the body. Each blade forming means to engage an inside surface of the body, the blades extending radially from the body. The blades form a cutting surface positioned toward a direction of rotation of the milling apparatus. A first longitudinal outer end surface perpendicular to a side cutting surface formed by the blade determines the radial extension of the blade. An inner longitudinal surface formed by the blade forms an angled cam surface, the cam surface being angled from an axis of the milling apparatus.

A cylindrical mandrel forms a first threaded end and a second pilot end. The mandrel further forms a tapered conical portion between the first and second end. The taper of the mandrel narrows from a large diameter nearest the second pilot end towards the first threaded end. The conical surface substantially parallels the angled inner longitudinal surface formed by the cutter blades. After the pair of cutter blades are positioned through the slots in the body, the mandrel is inserted through the second open end of the body. The conical surface of the mandrel contacts the angled inner cam surface of the cutter blades, thereby mechanically securing the blades between the body and the mandrel.

A mandrel retaining means is threaded to the first end of the mandrel thereby securing the mandrel within the body.

By mechanically securing the cutter blades within the pipe milling apparatus there are no external welds metallurgically securing the cutter blades to the body, hence, there is no degradation of the base metal material due to the heat generated by the welds.

Moreover, the multiplicity of tungsten carbide cutters secured to each of the replaceable blades are bonded to the blades in a brazing type furnace, thereby maintaining tight heat controls, thus assuring the integrity of the tungsten carbide cutters themselves as they are attached to the blades.

Each of the cutters on the cutting surface of the blades is mounted to the blades with a negative rake angle with respect to an axis of the milling apparatus, the negative rake angle is between 0 degrees and 15 degrees.

An optimum angle for each of the tungsten carbide cutters mounted to the blades is a negative rake angle of 7 degrees.

The above-noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
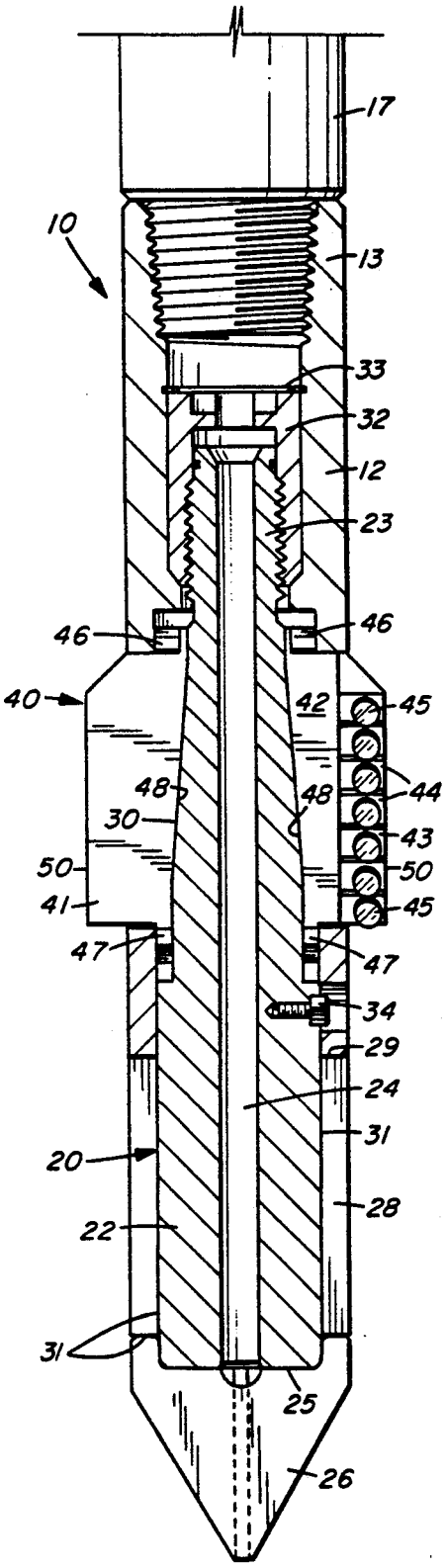
FIG. 1 is a cross-section of the milling apparatus illustrating components of the device.

FIG. 1 illustrates the milling apparatus generally designated as 10 inserted in a pipe encased well bore formed in a formation. The milling apparatus is connected to a drill string 17 (shown in phantom) at the top of the milling device. The milling device 10 is adapted to be engaged with the end of a metal well pipe (not shown).

The milling apparatus 10 consists of a cylindrical body 12 having an upper threaded end 13 adapted to be connected to the drill string 17. The body 12 forms four longitudinally extending slots 14 (FIG. 2) positioned between the end 13 and the open lower end 15 of body 12. The lower end 15 has a series of equidistantly spaced slots 27. These slots are designed to engage with pilot vanes 28 extending from a central mandrel generally designated as 20.

Four replaceable cutter blades generally designated as 40 are designed to be inserted through open end 15 of cylindrical body 12, the blades being subsequently pushed through slots 14 of the body 12 from the inside. Tabs 46 and 47 positioned at each end of the blades and oriented perpendicular to cutter surface 43 and back surface 41 prevent the blades 40 from being pushed all the way through the slots 14. The blade retention tabs 46 and 47 engage the inner wall 18 of cylindrical body 12.

The inner mandrel generally designated as 20 forms an inner fluid passage 24 that communicates with open end 13 of body 12. The conduit is designed to transmit drilling fluid or "mud" through the milling apparatus 10 and serves to provide fluid to wash the cuttings or detritus from the milled ends of the pipe encasement. The downstream or bottom end 25 of mandrel 20 defines a finned pilot or guide end 25 of the apparatus 10. Blades 26 are welded to the end 25 of the mandrel 20 and the four blades 26 continue into longitudinal radially extending blades or fins 28. The pilot end blades 26 and the extended fins 28 are welded along juncture 31 formed between the blades and the outer surface of the mandrel body 22. The upstream end 29 of the four blades 28 extend within slots 27 formed in end 15 of cylindrical body 12 when the mandrel is inserted all the way into the cylindrical body 12.

Each of the cutting blades 40 form a longitudinally extending angled surface 48. The surface is angled from a centerline of the milling apparatus 10. The angle surface 48 of the blade 40 is parallel with conical surface 30 formed by the mandrel 20. The conical surface of the mandrel tapers from a large diameter at the pilot end 25 to a smaller diameter toward the threaded end 23. The end 23 of the mandrel 20 is threaded so as to accept a locking nut 32 that is threaded onto threaded end 23 after the mandrel is inserted all the way into the body 12. When the mandrel is firmly inserted in the body 12, each of the blades 40 is firmly and mechanically locked within the slots 14 of the body 12.

Figure 2:
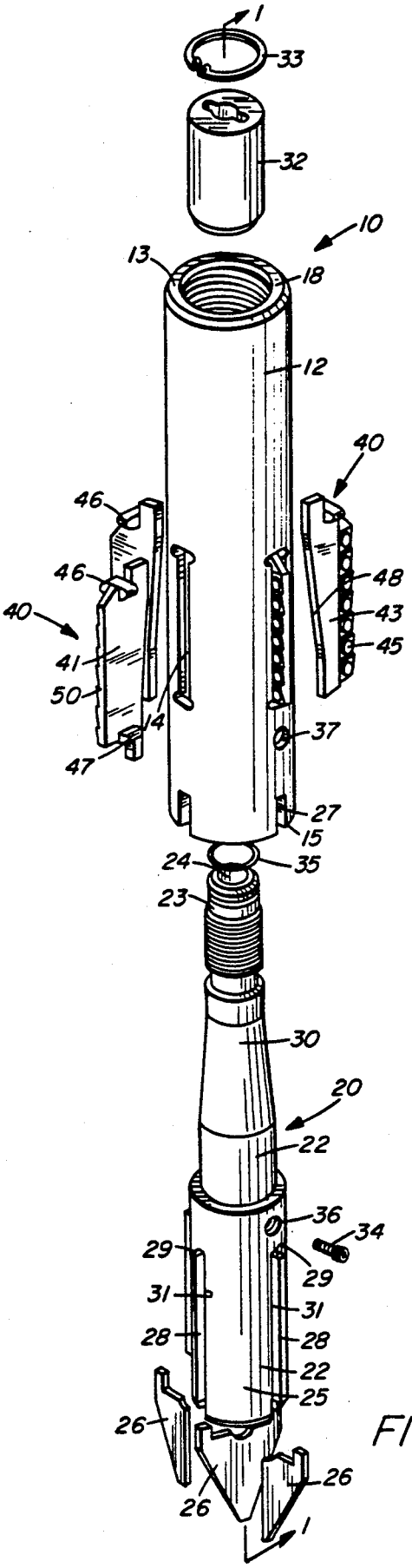
FIG. 2 is an exploded perspective view of the milling apparatus.

With reference now to the exploded perspective view of FIG. 2, the assembly procedure is readily discernible. The cutting blades 40 are inserted through the open end 15 of the body 12 and aligned with slots 14. When all of the four blades 40 are inserted through the slots 14 equidistantly spaced around the body 12, the mandrel 20 is then inserted into the interior of the body 12. The longitudinally extending fins 28 equidistantly spaced at 90 degree intervals around the end of the mandrel 25 are, of course, aligned with the slots 27 of end 15 of the body 12. An O-ring 35 is first placed within its cavity formed in the end 23 of the mandrel 20. End 29 of the fins 28 are then inserted within the slots 27 and the nut 32 is threaded onto end 23 of the mandrel 20. Once the nut 32 is tightly screwed onto the end 23 of the mandrel 20, a lock-ring 33 is snapped in place in its receptacle formed in the inner wall 18 of body 12.

Once the mandrel is securely positioned within the cylindrical body 12 each of the four cutters are mechanically locked to the body 12 and the milling apparatus is now ready for use to mill pipe downhole.

Figure 3:
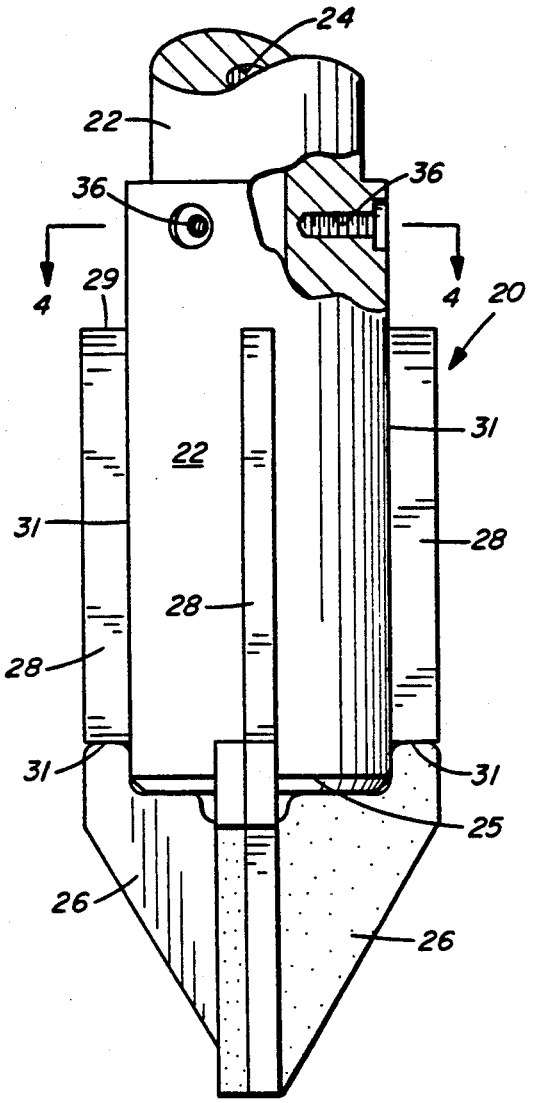
FIG. 3 is a partially cutaway view of the milling device showing the fixed pilot guide blades at the end of the mechanism.
Figure 4:
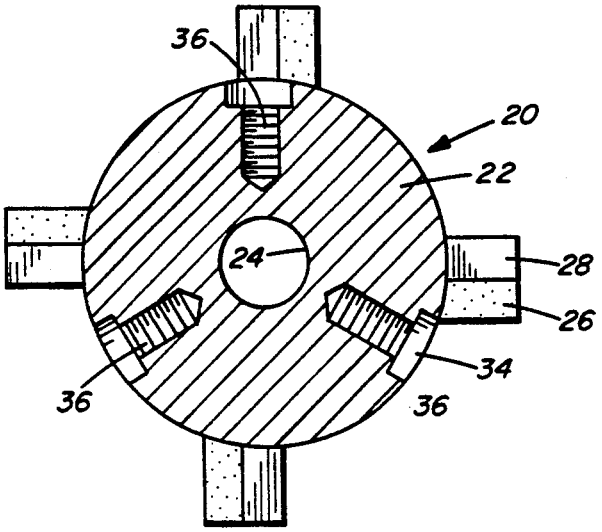
FIG. 4 is a view taken through 4-4 of FIG. 3 illustrating the retention bolts that mechanically retain the mandrel within the surrounding housing if the mandrel should break during operation.

Three mandrel retention bolts 34 are placed at 120 degree positions around the mandrel and serve to prevent the mandrel from being ejected from the body 12 in the event the mandrel should be severed from the body 12 (see FIGS. 3 and 4). The mandrel retention bolts are inserted after the milling apparatus is assembled. The bolts 34 are positioned within enlarged holes 37 formed through body 12 to coincide with the threaded holes formed in the mandrel body 22. Once the milling apparatus is assembled, the mandrel retention bolts are passed through the holes 37. The bolts indexing within the threaded receptacles in the mandrel. If the mandrel breaks, the head of the bolts 34 prevent the bottom portion of the mandrel from being ejected from the cylindrical body 12.

Turning now to FIG. 3, the lower pilot end 25 of the milling device is illustrated. The lower end of the mandrel body 22 supports the pilot guide fins of the apparatus. The four pilot fins 26 are welded at end 25 along junction 31. The leading, or forward face, of the pilot fins 26 have, for example, an abrasive coating that facilitates removal of detritus that may be preventing the milling apparatus from seating on the top of the casing. Each of the welded on tips 26 continues into longitudinal fins 28 welded to the mandrel body 22. As heretofore stated, end 29 of the fins 28 registers with slots 27 formed in the end 15 of the cylindrical body 12.

FIG. 4 is a section taken through FIG. 3 showing the positions of the mandrel retention bolts 34 in the body 22 of the mandrel. As indicated before, the central opening 24 serves to pass drilling fluid through the milling apparatus, the drill fluid serving to wash the detritus or chips from the cutting action of the blades to facilitate more rapid milling of the end of the casing.

With reference again to FIGS. 1 and 2 the cutting blades are shown in detail. FIGS. 1 and 2 shown a side view of the separate cutting blades, generally designated as 40. The blade consists of a cutting face 43 formed on the body 42, the inner surface 48 is perpendicular to the cutting face 43. The inner surface 48 is angled with respect to a centerline or axis of the milling apparatus. The angle 48 coincides with the conical surface 30 of the internal mandrel 20. A pair of tabs or shoulders 46 and 47 extend perpendicular to cutting surface 43 and back surface 41. The tabs serve as a means to prevent the blades 40 from passing all the way through the slots 14 of cylindrical body 12. The cutting surface 43 has a series of radially extending slots 44 formed in the face 43.

Figure 5:
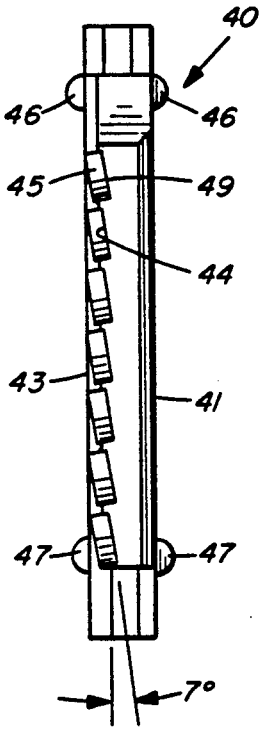
FIG. 5 is a side view of one of the replaceable cutter blades illustrating the tungsten carbide cutter discs mounted to the cutting surface of the blade.

Referring now to FIG. 5, the slots 44 are angled with respect to a centerline or an axis of the milling apparatus, the angle being a negative rake angle with respect to the axis. The angle of each of the slots may be between 0 degrees and 15 degrees negative rake angle. The optimum or preferred negative rake angle is 7 degrees.

A multiplicity of, for example, tungsten carbide disc 45 are metallurgically bonded within the slots 44. Each of the multiplicity of tungsten carbide cutters are aligned substantially longitudinally to intersect the end of casing thereby providing maximum cutting action to mill the casing. The tungsten carbide disc may, for example, be a Grade 363 or HS6 manufactured by RTW (Rogers Tool Works). The manufacturer is located in Rogers, Ark. It should be pointed out that other types of cutters may be utilized while remaining within the scope of the present invention. As heretofore mentioned, the tungsten carbide cutters may be brazed within a brazing furnace at tightly controlled temperatures to affect a maximum bond between the tungsten carbide discs and the slots 44 formed in cutting face 43 of the replaceable blades 40. This brazing process is well known in the state-of-the-art. It should, again, be pointed out that the foregoing controlled brazing process maximizes the strength of the bond between the tungsten carbide and the replaceable blades without degradation of the blades.

One or more radially disposed chip breaker ridges may be formed on a cutting surface of the individual tungsten carbide cutters (not shown). The chip breakers serve to break up long "tails" of cuttings removed from end of the steel pipe casing during operation of the milling apparatus 10 in a borehole. The cuttings, if not kept to a small size, could bind between the drill pipe 17 and the borehole preventing the mud from removing the cuttings (see FIG. 1).

It would be obvious to angle each of the slots 14 in cylindrical body 12 at a negative rake angle between 0 degrees and 15 degrees with respect to an axis of the milling apparatus 10. The tungsten carbide cutters 45 could then be brazed flat onto cutting surface 43 of the blades 40 without departing from the scope of this invention.

It will, of course, be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A pipe milling apparatus having replaceable milling blades fixedly secured within said apparatus prior to insertion of said apparatus into a wellbore for milling and cutting pipe utilized in oil and gas wells, said milling apparatus comprising:

a cylindrical body, said body forming a first upstream threaded end adapted to be connected to a drill string and a second downstream open, said body further forming at least a pair of equidistantly spaced, longitudinally extending slots therethrough positioned about midway between said first and second ends of said body, at least a pair of pipe milling blades forming first and second ends adapted to be radially inserted through said slots in said cylindrical body from the inside of said body, means formed by said blade to fixedly secure said blade against an inside wall formed by said body, said blades extend radially from said body, said blades further form a cutting surface positioned toward a direction of rotation and along a radially disposed second downstream end formed by said milling blades, said cutting surface containing cutting means oriented substantially longitudinally adjacent said first longitudinally extending outer surface, the cutting means being positioned to mill said pipe as said milling apparatus is rotated, a first longitudinally extending outer surface formed by said blade determines the radial extension of said blade, an inner longitudinally extending surface formed by said blade forms an angled cam surface, the cam surface being angled from an axis of the milling apparatus, a cylindrical mandrel confined within said cylindrical body and forming a first upstream end and a second pointed downstream pilot end said second pilot end serves to centrally guide said pipe milling apparatus down said well bore and into an end of said pipe to be milled, said mandrel further forming a tapered conical portion between said first and second end, the taper of the mandrel narrows from a large diameter nearest the second pilot end towards the first upstream threaded end, said conical surface substantially parallels said inner longitudinally extending surface formed by said cutter blades.

2. The invention as set forth in claim 1 wherein said cutting means is a multiplicity of equidistantly spaced cutting elements oriented substantially longitudinally adjacent said first outer surface of said blade.

3. The invention as set forth in claim 1 wherein said means formed by said blade to secure said blade against said inside wall of said cylindrical body is an extending tab protruding perpendicular to said cutting surface and to a back surface of said blade, a pair of said tabs being positioned at each longitudinal end of said blades, said perpendicular tabs engage said inside wall of said body.

* * * * *